United States Patent [19]

Brackmann et al.

[11] 3,954,112

[45] May 4, 1976

[54] TOBACCO FILLER ROD PRODUCTION

[75] Inventors: Warren A. Brackmann, Cooksville; Daniel Di Ianni, Toronto, both of Canada

[73] Assignee: Rothmans of Pall Mall Canada Limited, Toronto, Canada

[22] Filed: Aug. 5, 1974

[21] Appl. No.: 494,728

[52] U.S. Cl. ..... 131/21 D; 131/84 C

[51] Int. Cl.[2] ..... A24C 5/18

[58] Field of Search ..... 131/21 B, 21 D, 84 B, 131/84 C

[56] References Cited

UNITED STATES PATENTS

| | | | |
|---|---|---|---|
| 3,045,681 | 7/1962 | Richter | 131/84 C X |
| 3,088,468 | 5/1963 | Labbe | 131/84 C X |
| 3,277,897 | 10/1966 | Gamberini | 131/84 C X |
| 3,318,314 | 5/1967 | Stelzer | 131/84 C |
| 3,338,247 | 8/1967 | Labbe | 131/21 D |
| 3,495,599 | 2/1970 | Molins | 131/84 B |

*Primary Examiner*—Louis G. Mancene
*Assistant Examiner*—John F. Pitrelli
*Attorney, Agent, or Firm*—Sim & McBurney

[57] ABSTRACT

Hardness variations in a tobacco filler rod are detected and corrected in a single operation in conjunction with trimming of the tobacco to provide a trimmed filler rod of uniform height and uniform hardness. The single operation detection and correction is achieved by using force-applying member to compress the tobacco to a greater or lesser extent immediately prior to trimming, the degree of compression depending on the compressive force applied and the resistance of the tobacco to compression.

6 Claims, 8 Drawing Figures

TOBACCO FILLER ROD PRODUCTION

FIELD OF INVENTION

This invention relates to the production of a tobacco filler rod for use in the production of cigarettes.

BACKGROUND TO THE INVENTION

In the conventional formation of cigarettes, a filler stream having variations in quantities of tobacco in its length is conveyed on an air previous band under the influence of vacuum applied to the band to a trimmer where any tobacco above a predetermined distance from the conveyor surface is trimmed from the stream. The trimmed filler rod then is compressed to a uniform diameter prior to wrapping in paper to form a continuous cigarette rod from which discrete cigarettes are formed.

Unfortunately, in this procedure, the vacuum applied to the filler stream causes the density of tobacco to vary along the length of the stream, the variations depending on the quantity of tobacco in the stream. To compensate for these variations, in an attempt to provide a uniform density cigarette filler rod, the prior art has used one of two methods. In the first such method, the trimmer is moved relative to the conveying band to vary the distance of the trimmer from the conveying band in response to upstream-measured quantity and/or density variations. The second method involves maintaining the trimmer in a fixed position relative to the conveying band so that the distance between the conveying band and the trimmer is substantially constant while the vacuum applied to the conveying band and hence to the filler stream is varied in response to upstream-measured variations in quantity and/or density of the stream.

The aim of both these prior art methods is to vary the quantity of tobacco trimmed from the stream in response to variations in the density of the untrimmed stream, in order to provide a uniform quantity cigaratte filler rod for formation into cigarettes.

The prior art methods, while successful to a degree in improving the uniformity of the quantity of the cigarette filler rod, suffer from the drawback that relatively long lengths of the stream are subjected to adjustment or correction for density variations and the density adjustments can only be made as an average over a particular length of stream and hence density and resulting quantity variations remain. This effect arises from the lack of rapid response of trimming adjustment devices compared to abrupt variations in the high speed tobacco stream. Hence, the prior art methods are incapable of providing a completely uniform quantity cigarette filler rod.

Further both these prior art methods assume that the compression characteristics of the tobacco are uniform along the length of the stream.

However, this is often not the case, but such variations tend on average to cancel each other out. However, when the correction in the quantity of tobacco trimmed is made in accordance with the upstream-determined density and/or quantity variations, to provide the uniform quantity rod after trimming, the operation will result in hardness variations in the trimmed rod. Hence, even if a uniform quantity filler rod were provided by the prior art, variations in hardness of the filler rod often remain, leading to the provision of cigarettes of inconsistent quality.

In addition to these drawbacks, the prior art methods require separate detection and correction operations, necessitating the use of complicated and sophisticated apparatus.

SUMMARY AND GENERAL DESCRIPTION OF INVENTION

In the present invention, the hardness of the filler stream in successive juxtaposed incremental lengths thereof is detected and the tobacco in the incremental lengths is compressed to provide a filler stream which is trimmed to remove excess tobacco from the filler stream above a predetermined height to provide a filler rod having a uniform height and a uniform hardness. The detection and compression steps are carried out simultaneously.

Thus, the hardness of each small juxtaposed incremental length of the rod, typically having a length less than 1 inch, preferably less than ½ inch, is adjusted using a detecting and adjusting mechanism so that the required amount of tobacco can be trimmed to provide a uniform hardness rod.

Since it is the hardness of the filler stream which is detected and the filler stream is compressed to a greater or less extent in incremental lengths prior to trimming, the procedure of the present invention results in a filler rod of uniform height and hardness along its length irrespective of variations in the resistance of the tobacco to compression of the filler stream.

Thus, in instances where the tobacco possesses a uniform resistance to compression, the procedure of the invention is directed to the production of a trimmed filler rod having a uniform height, and hence hardness, as in the prior art procedures. In the present invention, a fixed trimmer height is used, as in one of the prior art procedures, but in place of a change in vacuum force in response to separately measured density variations to vary the degree of compression of the stream prior to trimming, the density variation are measured and the tobacco is compressed to the required degree in the same operation. Further, in the present invention, each incremental length of filler rod is subjected to individual detection and compression rather than the prior art procedure wherein average density variations over a comparatively long length of filler rod are detected and compensated for.

In the case where the tobacco in the filler rod has a variable resistance to compression, the procedure of the invention automatically compensates for those variations, compressing less hard tobacco more than harder tobacco in incremental lengths of the same height, to provide a trimmed rod which may have a non-uniform quantity but which has a uniform hardness. The procedure in this case is quite different than the prior art wherein hardness variations are detected as if they were density variations resulting in an adjustment which is the reverse of that desired.

Consistent cigarette quality is considered by the consumer to be indicated by a consistent "feel" to the cigarettes. It is the hardness of the cigarette which provides this "feel" and hence the provision of cigarettes having a consistent hardness, as provided by the present invention, leads to greater consumer acceptance.

The procedure of the present invention may be carried out in any convenient manner by simultaneously detecting variations in hardness of the vacuum conveyed stream and compressing the tobacco the required amount just prior to trimming.

A force applying member is utilized in the present invention to achieve the simultaneous detecting and adjusting. Since the variations in rod hardness are detected and adjusted simultaneously, each incremental length of the stream may be manipulated to suit its particular requirement, rather than manipulation occurring to suit the average of a relatively long length of stream as practiced in the prior art procedures outlined above. In addition, the simultaneous detection and adjustment procedures eliminate the necessity for the complicated and sophisticated sensing and information processing and forwarding equipment of the prior art techniques.

DESCRIPTION OF PREFERRED EMBODIMENTS

Figure 1:
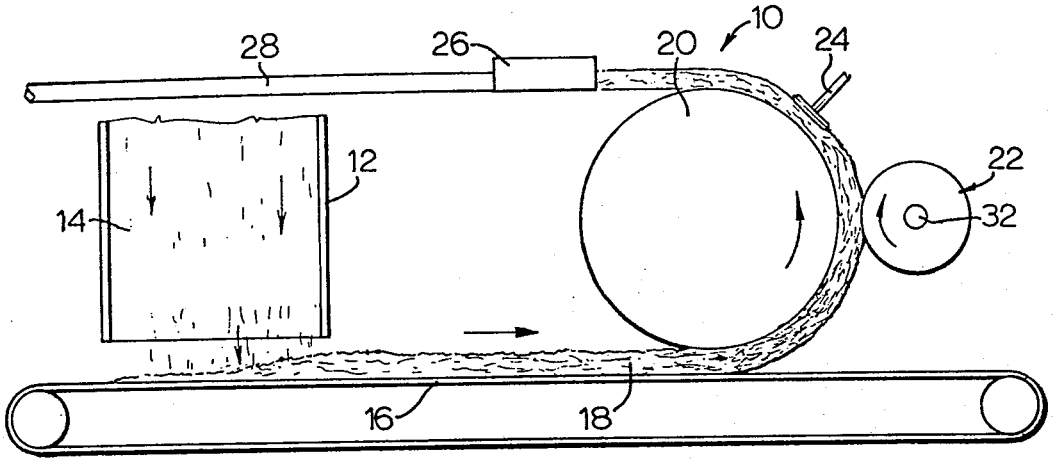
FIG. 1 is a schematic elevational representation of a cigarette making machine utilizing the present invention.

In the drawings, FIG. 1 illustrates a typical cigarette making machine 10 modified in accordance with the present invention. The machine 10 includes a falling tobacco stream-forming chute 12 through which a relatively wide and thin stream of tobacco particles 14 is downwardly fed towards a conveyor 16 moving transverse to the path of movement of the stream 14 and on which a filler stream 18 is formed.

The filler stream 18 is transported on the conveyor 16 to a rotating vacuum wheel 20 which transports the filler rod on a peripheral foraminous surface first past a manipulating member 22, described in more detail below, and then past a trimmer 24 of any convenient form.

The trimmed tobacco is transferred from the wheel 20 to the feed mechanism of a compression and wrapping assembly 26 wherein the trimmed rod is compressed and wrapped in paper to form a continuous cigarette rod 28 from which individual cigarettes are formed as disclosed, for example in U.S. Pat. No. 3,724,468.

The manipulating member detects changes in hardness of the filler stream as it is conveyed past on the vacuum wheel 20 and simultaneously compresses the tobacco to a greater or lesser extent, depending on the detected hardness to provide a filler rod having a substantially uniform hardness after trimming by the trimmer 24.

The filler stream is trimmed by the trimmer 24, which has a substantially fixed position with respect to the conveying surface of the vacuum wheel 20, to remove more or less tobacco, depending on the quantity extending above the height of the blade of the trimmer 24 from the conveying surface of the vacuum wheel 20. The trimmed tobacco is collected and recycled to the formation of the falling stream 14.

There results from the trimmer 24, a trimmed filler rod which has a substantially uniform height and a substantially uniform hardness, allowing the production of a cigarette rod 28 of substantially uniform hardness.

Figure 2:
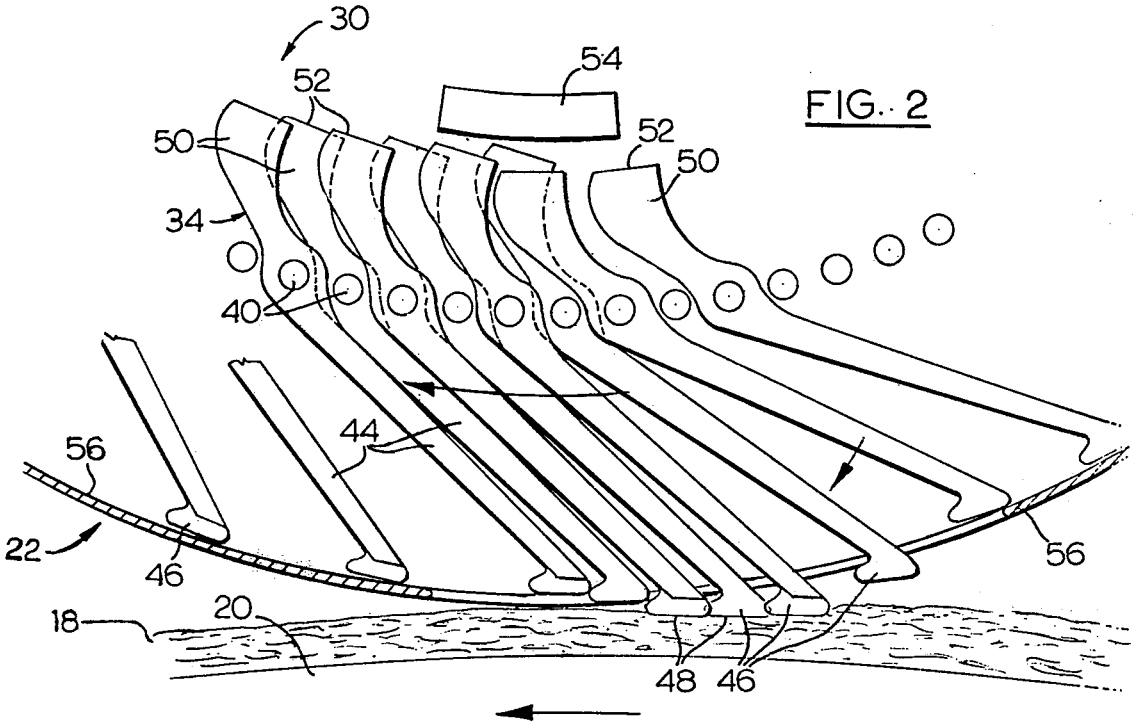
FIG. 2 is a close up elevational schematic representation of a device of the invention, utilizable in the machine of FIG. 1.
Figure 3:
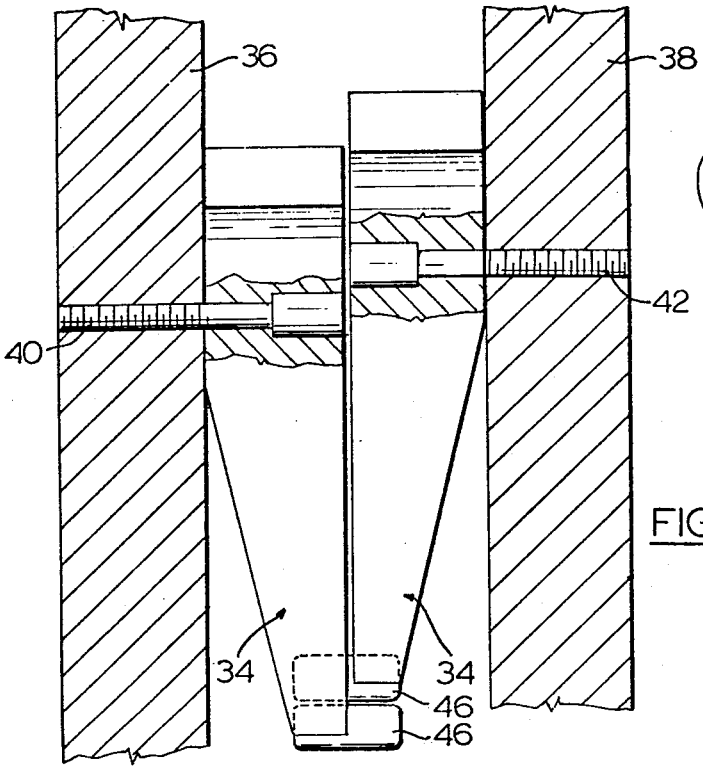
FIG. 3 is a plan view, partly in section of part of the device of FIG. 2.
Figure 4:
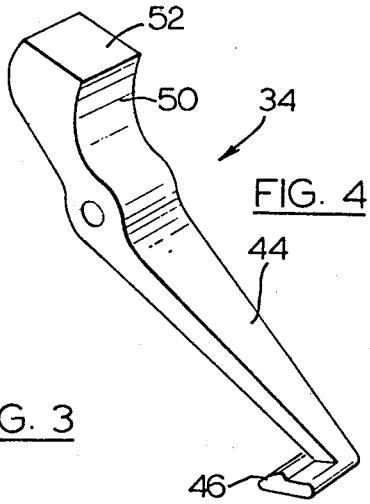
FIG. 4 is a perspective view of a tamper arm utilized in the embodiment of FIGS. 2 and 3.

The manipulation member 22 and its relationship with the vacuum wheel 20 are shown in more detail in FIGS. 2 to 4.

The manipulation member 22 takes the form of a wheel 30 mounted for rotation on its axle 32 so that, at their point of nearest approach, the peripheral surface of the vacuum wheel 20 and the periphery of the wheel 30 move in the same direction.

The wheel 30 carries a plurality of tamping arms 34 mounted in circumferentially-spaced relationship with respect to each other. Each of the tamping arms 34 is pivotally mounted to one of a pair of circular members 36 and 38 which are connected to the axle 32 of the wheel 30 in any convenient manner, such as by spokes or ribs.

Each alternate tamping arm 34 is mounted on pivot pins 40 to the member 36 while the remainder are mounted on pivot pins 42 to the member 38 the pivot pins 40 and 42 being generally parallel to the axle 32 of the wheel 30.

Each tamping arm 34 includes a first part 44 extending away from the respective pivot pin 40 or 42 and the axle 32 and rearwardly of the intended direction of motion of the wheel 30, terminating at its outward end in a foot 46 which has an outwardly-facing tobacco-engaging surface 48.

The pivoting of each alternate tamping arm 34 on the same member allows the close juxtaposition of the feet 46 of adjacent arms 34 as shown in FIG. 3, without interference of the arms 34 one with another during pivotal movement about their respective pivot pins.

The tamping arm 34 includes a second part 50 extending away from the pivot pin 40 or 42 towards the axle 32 and in the direction of intended motion of the wheel 30. The second part 50 terminates at its end remote from the pivot pin 40 or 42 in a flat surface 52.

A magnet 54 of any convenient type is mounted on the wheel 30 in fixed location to exert a magnetic influence on arms 34 located in the proximity thereof, as discussed in more detail below. A cam track, shown schematically at 56, extends around the majority of the periphery of the wheel 30 except in the area adjacent the vacuum wheel 20. The cam track 56 retains the feet 46 of the arms 34 at a predetermined fixed radial distance from the axle 32 of the wheel 30 until the arms 34 successively reach a predetermined position adjacent the vacuum wheel 20, at which point they are released successively by the cam track 56.

OPERATION

In operation, the filler stream 18 is conveyed on the vacuum wheel 20 past the wheel 30 to the trimmer 24 for the removal of tobacco therefrom. As the wheel 30 rotates, the foot 46 of each tamper arm 34 is released from engagement with the cam track 56. When the foot 46 is released the centrifugal force acting on the arm 34 causes the arm to pivot about its pivot pin 40 or 42 and the foot 46 to move further away from the axle 32.

The surface 48 of the foot 46 engages the top surface of the tobacco in the filler stream 18 and applies a compressive force to the tobacco in a degree which depends on the momentum of the foot 46 when it engages the tobacco. If the foot 46 travels a relatively long distance before engaging the tobacco, then the momentum gathered will be greater and hence the compressive force applied to the tobacco will be greater. However, if the foot 46 travels a relatively short distance before engaging the tobacco, then the momentum gathered will be less and hence the compressive force applied to the tobacco will be less.

The tobacco subjected to the greater compressive force is compressed more than tobacco subjected to the lower compressive force, if the tobacco in the filler stream has a uniform resistance to compression. However, where the resistance of the tobacco to compression varies in the length of the filler stream, the degree of compression of the filler stream will depend both on the compressive force applied and on the resistance of the tobacco compression. Thus, for a uniform force, less compressiveforce resistance tobacco is compressed more than more compresssiveforce resistant tobacco.

Therefore, in each incremental length of the filler stream 18 engaged by a foot 46, the tobacco will be compressed to a lesser of greater degree depending on the distance of travel of the foot 46 prior to engagement with the tobacco and the resistance of the tobacco to compression.

Thus, the density variations introduced to the filler rod by vacuum due to height variations are eliminated and after trimming a filler rod of substantially uniform height and hardness is obtained.

Since the arms 34 are mounted so that the feet may be substantially juxtaposed, each incremental length of the filler stream 18 is subjected to the compressive force of one of the arms 34, the size of the incremental length depending on the dimensions of the feet 46.

The compressive effect also is enhanced with the assistance of the magnet 54. As the foot 46 moves further away from the axle 32 the closer the face 52 comes to the magnet 54 and hence the greater is the magnetic attractive force on the second part 50 of the arm 34, thereby again varying the compressive force applied by the foot 46 on the tobacco with the distance of travel of the foot 46 to its engagement with the filler stream 18.

The total force applied by the foot 46 to the tobacco in the filler stream 18 over each incremental length thereof may be varied by altering the power of the magnet 54, or by altering the release position of the foot 46 from the cam track 56.

The foot 46 after the compression, is reengaged by the cam track 56 for rotation by the wheel 30 to the release point. The procedure is repeated by each successive arm 34 on successive incremental lengths of the filler stream 18.

Following compression of the tobacco in the filler stream 18 to a greater or lesser extent by the feet 46, the filler stream 18 is forwarded to the trimmer 24, where tobacco is removed from the rod 18 located above a predetermined height from the peripheral surface of the suction wheel 20. Tobacco has a slow rebound or recovery rate when compressed, as is well known from the dense end method wherein the filler stream is punch compressed at predetermined spaced-apart locations prior to trimming. After compression by the arm 34, therefore, while some rebounding may occur towards the original location of the tobacco during passage of the filler stream 18 from the manipulating member 22 to the trimmer 24, at the speed of operation of the cigarette making machine 10, trimming occurs before any substantial rebound of tobacco can occur. Hence, the quantity of tobacco trimmed from the filler stream is substantially that indicated by detection and compression achieved by the tamper arms 34 in each successive incremental length of the filler stream 18.

It will be seen therefore, that the tamper arms 34 detect automatically variations in the hardness of tobacco along each incremental length of the filler stream 18, since the variations cause individual ones of the arms 34 to move different distances towards the wheel 20 before encountering the tobacco and to compress the tobacco to a greater or less extent, the less hard lengths being compressed greater than the more hard lengths, so that upon trimming there remains in the trimmed rod sufficient tobacco at each incremental length to provide a substantially uniform hardness filler rod.

DESCRIPTION OF ALTERNATION EMBODIMENTS

The description of the invention with reference to the embodiment of FIGS. 1 to 4 has taken place with reference to the manipulation and trimming of the filler stream 18 while transported on the curved periphery of the vacuum wheel 20. The invention may be utilized, if desired, while the filler stream is transported on a substantially flat surface.

Figure 5A:
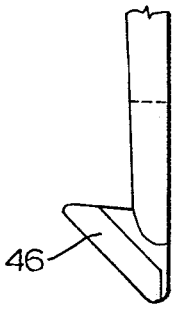
FIGS. 5A and 5B respectively show side and front elevational views of the foot portion of an alternative tamper arm utilizable with the embodiment of FIGS. 2 and 3.
Figure 5B:
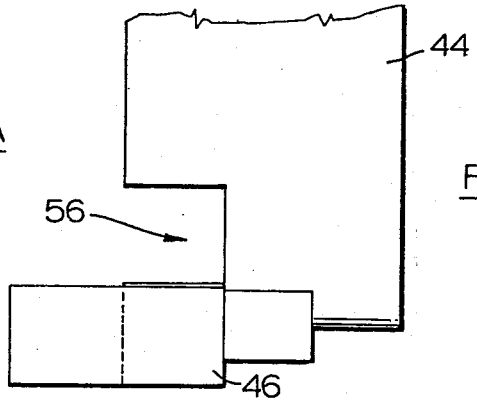
Figure 6A:
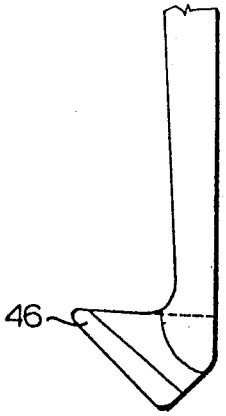
FIGS. 6A and6B respectively show side and front elevational views of the foot portion of a further alternative tamper arm utilizable with the embodiment of FIGS. 2 and 3.
Figure 6B:
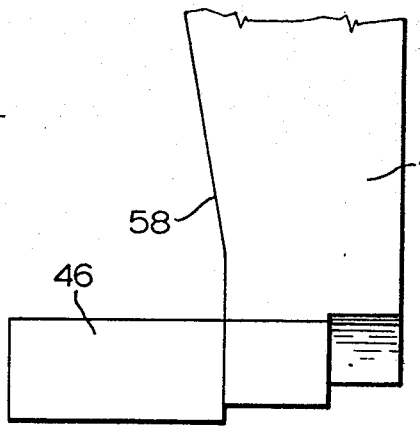

Turning now to FIGS. 5 and 6, there are illustrated alternative forms of tamper arm 34 for use in the embodiment of FIGS. 1 to 4.

As seen the structure of FIG. 5, the first part 44 is formed with a notch 56 therein allowing free movement of the foot 46 of the adjacent arm 34 therethrough, if necessary.

The embodiment of FIG. 6 is similar to that of FIG. 4, except that the notch 56 has been replaced by a cutaway 58 increasing in depth from the pivot to the foot 46.

SUMMARY

The present invention therefore provides method and apparatus for the production of a tobacco filler rod of uniform hardness, which is superior to the prior art.

Modifications are possible within the scope of the invention.

What we claim is:

1. In a cigarette-making apparatus comprising filler stream-forming means, conveying means for conveying said filler stream to a cigarette rod-forming means, vacuum inducing means operatively associated with said conveyor means for applying suction to a filler stream conveyed by said conveyor means and tobacco trimming means mountiing in a substantially fixed location spaced from said conveyor means in cooperative relationship therewith to remove tobacco from a filler stream on said conveyor means above a predetermined height from said conveyor means, the improvement comprising filler stream manipulating means located adjacent to and upstream of said trimming means for subjecting the tobacco in each successive incremental length of the filler stream to a compressive force towards said conveyor means, said filler stream manipulating means including a plurality of movable individual compressive force-applying members arranged successively to contact successive incremental lengths of said filler stream, centrifugal force-imparting means and magnet means associated with said individual force-applying members and arranged to impart force to said individual force-applying members of magnitude increasing proportionally with distance of movement of said force-applying members into said contact with said successive incremental lengths, whereby each incremental length of filler stream is subjected to a compressive force equivalent to the force of the individual force-applying member contacting the same and gained in motion to the incremental length under the influence of a combination of centrifugal forces and magnetic forces.

2. In a cigarette-making apparatus comprising filler stream-forming means, conveying means for conveying said filler stream to a cigarette rod-forming means, vacuum inducing means operatively associated with said conveyor means for applying suction to a filler stream conveyed by said conveyor means and tobacco trimming means mounting in a substantially fixed location spaced from said conveyor means in cooperative relationship therewith to remove tobacco from a filler stream on said conveyor means above a predetermined height from said conveyor means, the improvement comprising filler stream manipulating means location adjacent to and upstream of said trimming means for subjecting the tobacco in each successive incremental length of the filler stream to a compressive force towards said conveyor means, said filler stream manipulating means comprising a wheel rotatable on its axis, a plurality of arm members pivotally mounted on pivots on said wheel, said pivots extending generally parallel to said wheel axis, said pivots being located radially remote from said wheel axis in equally circumferentially spaced locations, each of said arm members having a portion thereof extending from its pivot angularly to the radius of the wheel on which said pivot is located away from said wheel axis and terminating in a foot having a tobacco filler stream- engaging surface, and retaining means associated with said wheel to hold said arm members in a substantially fixed location relative to said wheel axis during the majority of the intended rotation of said wheel and to release successively said arm members adjacent said filler stream conveying means to allow pivotal movement of said arm members in succession about said pivots under the influence of the centrifugal force induced during the rotation of the wheel and engagement of the tobacco filler stream engaging surfaces of successive feet on successive incremental lengths of the filler stream.

3. The apparatus of claim 2 wherein each of said arm members has a further portion extending inwardly of the pivots and including magnet means mounted in fixed position in association with said wheel to apply magnetic forces to the further portion of the arms after said release.

4. A method of forming a continuous cigarette rod which comprises forming an elongate tobacco filler stream from a relatively wide and thin stream of tobacco particles, said tobacco filler stream having variations in hardness along its length and containing an excess quantity of tobacco with respect to that ultimately required in said continuous cigarette rod, conveying said filler stream under the influence of vacuum, moving a plurality of force-applying members in a circular path adjacent said filler stream to subject said plurality of force-applying members to centrifugal forces, restraining said plurality of force-applying members from movement under the influence of said centrifugal forces for a predetermined portion of said circular path, releasing successive members of said plurality of force-applying members from said restraint in the remainder of said circular path and allowing each successive member to move under the influence of said centrifugal forces towards said filler stream for respective engagement of each successive juxtaposed incremental length of the filler stream, applying a compressive force to the tobacco in the respective incremental length of the filler stream of magnitude equal to the force generated in the respective force-applying member in its movement into engagement with the tobacco and proportional to the distance of travel of the force-applying member under the influence of said centrifugal forces, compressing the tobacco in each incremental length of filler stream in accordance with the compressive force applied and the resistance of the tobacco in the incremental length to compression, removing tobacco from the compressed filler stream located beyond a predetermined fixed thickness of said rod substantially immediately after said compression to provide a filler rod of substantially uniform hardness, compressing the trimmed rod to substantially uniform diameter, and wrapping said uniform diameter rod in paper to provide said continuous cigarette rod.

5. The method of claim 4, including subjecting said force applying members to magnetic forces of increasing magnitude during said movement into engagement with said filler stream to increase said compressive force.

6. In a cigarette-making apparatus comprising filler stream-forming means, conveying means for conveying said filler stream to a cigarette rod-forming means, vacuum inducing means operatively associated with said conveyor means for applying suction to a filler stream conveyed by said conveyor means and tobacco trimming means mounted in a substantially fixed location spaced from said conveyor means in cooperative relationship therewith to remove tobacco from a filler stream on said conveyor means above a predetermined height from said conveyor means, the improvement comprising filler stream manipulating means located adjacent to and upstream of said trimming means for subjecting the tobacco in each successive incremental length of the filler stream to a compressive force towards said conveyor means, said filler stream manipulating means including a plurality of individual compressive force-applying members arranged successively to contact successive incremental lengths of said filler stream, and magnet means associated with said individual force applying members for providing each of said force-applying members with a force, whereby each incremental length of filler stream is subjected to a compressive force equivalent to the force of the individual force-applying member contacting the same and gained in motion of the individual member to the incremental length under the influence of magnetic forces.

* * * * *